US006109512A

United States Patent [19]

Morrison

[11] Patent Number: 6,109,512

[45] Date of Patent: Aug. 29, 2000

[54] ANGLED FRONT LOCK SYSTEM FOR HANDLED PIZZA CARTON

[75] Inventor: Mark D. Morrison, St. Louis, Mo.

[73] Assignee: Jefferson Smurfit Corporation, St. Louis, Mo.

[21] Appl. No.: 09/144,483

[22] Filed: Aug. 31, 1998

[51] Int. Cl.[7] ..... B65D 5/24; B65D 5/42

[52] U.S. Cl. ..... 229/110; 229/148; 229/906

[58] Field of Search ..... 229/110, 148, 229/149, 902, 906

[56] References Cited

U.S. PATENT DOCUMENTS

| | | | |
|---|---|---|---|
| 1,482,727 | 2/1924 | Borchers | 229/110 |
| 5,110,039 | 5/1992 | Philips . | |
| 5,118,032 | 6/1992 | Geho | 229/110 |
| 5,211,329 | 5/1993 | Patton . | |
| 5,368,225 | 11/1994 | Ritter . | |
| 5,381,949 | 1/1995 | Correll . | |
| 5,452,845 | 9/1995 | Ritter | 229/906 |
| 5,535,940 | 7/1996 | Olds . | |
| 5,553,771 | 9/1996 | Correll . | |
| 5,713,509 | 2/1998 | Correll . | |
| 5,833,130 | 11/1998 | Correll | 229/906 |

*Primary Examiner*—Gary E. Elkins
*Attorney, Agent, or Firm*—Paul M Denk

[57] ABSTRACT

A folder type paperboard container formed from a single piece having a hexagonal bottom wall panel, a rear wall panel, a front wall panel, a pair of side wall panels and a cover panel. The front wall panel includes a tuck that adds strength to the location and also serves as a securing mechanism. The securing mechanism does not extend beyond the front panel. The cover panel includes two depending flaps that cooperate with and are part of the securing mechanism. The folder type container includes an angled front panel arrangement that secures the cover in place, requires less material, and increases the strength of the center front section of the box where it generally is grasped by a handler.

9 Claims, 9 Drawing Sheets

ANGLED FRONT LOCK SYSTEM FOR HANDLED PIZZA CARTON

CROSS-REFERENCE TO RELATED APPLICATIONS

None

BACKGROUND OF THE INVENTION

This invention relates generally to folder type containers and blanks made of paper or cardboard other related materials and, in particular, to folder type boxes for containing pizza or other relatively flat food products or the like.

Pizza boxes or other substantially flat folder type containers for holding pizza or other food products are known to the art. Generally speaking, pizza boxes are constructed from foldable blanks or other forms of corrugated or paperboard stock. Most commonly the pizza box is a flat, rectangular box having an integral lid that can be secured in a closed position. The blanks are supplied to the pizza restaurant in a flat, unfolded configuration and then folded into its useful position on site. A plurality of boxes usually are prefolded and stored for use. The pizza restaurant places hot pizza in the container for carry-out by a customer or for delivery by the restaurant's delivery personnel. The flat tray type containers also can be used to carry-out leftovers or other relatively low profile food products such as bread sticks or the like and are not limited to pizza. Preferred containers should be relatively strong, convenient to construct on site and economical to use. It also is preferable that the container retain heat so that the carry-out or delivered pizza remains ready to eat. The container should be designed to restrict sliding of the pizza inside.

Pizza boxes represent a considerable product to the pizzeria owner, particularly when the pizzeria enjoys substantial carry-out or delivery business. Also, failure of the box, for example, by collapsing or accidental opening of the cover resulting in the spilling of the contents, can add to product costs and also customer dissatisfaction. As discussed in the prior art U.S. Pat. No. 5,381,949 (col. 1, lines 40–45), box structures can have weak spots along the front edge of the bottom of the box. Labor is another factor which adds to product costs. The time required to fold and set-up the pizza boxes is a labor cost added to overhead. An additional desirable convenience and time-saving feature is the ability to slice the pizza inside the box. Thus, the restaurateur always is eager to find a strong, yet economical container which can be folded and set-up quickly, prevent product shifting and yet allow in-box slicing.

Examples of prior art pizza boxes include U.S. Pat. Nos. 5,110,039; 5,211,329; 5,368,225; 5,381,949; 5,535,940; 5,553,771; and 5,713,509.

Generally speaking, all prior art pizza boxes can be improved by decreasing the amount of paperboard material required which, in turn, decreases the cost of production. Further, such boxes can be improved by increasing the strength of the box, particularly at the front center edge area of the box where it generally is grasped by a handler. Moreover, the containers can be greatly improved by incorporating a locking feature that will secure the lid in place, particularly where the locking feature is located at the front center area of the box and consequently adds to the strength of the box in that critical area without increasing the amount of material used to construct the box.

SUMMARY OF THE INVENTION

It is, therefore, among the several objects of the present invention to provide an improved folder type container which uses substantially less material than a standard pizza box.

It is another object of the present invention to provide such a folder type container that is stronger that a conventional pizza box.

Another object of the present invention is to provide such a folder type container that includes an improved structure for supporting the front center portion of the box and lid to enhance strength characteristics of the container when grasped or handled in the front center area.

Another object of the present invention is to provide such a folder type container that includes an angled front lock mechanism that secures the cover in place, requires less material, and increases the strength of the center front section of the box where it generally is grasped by a handler.

Another object of the present invention is to provide such a folder type container that has improved heat retention characteristics.

Still another object of the present invention is to provide such a folder type container that is quick and easy to assemble.

Another object of the present invention is to provide such a folder type container that has an improved locking mechanism for securing the container lid in a closed position.

Another object of the present invention is to provide such a folder type container comprised of a paperboard blank that includes waste and cut outs on the lead end and trail end of the blank so as to accommodate the cutting of several container blanks from one large piece of stock in a side-by-side arrangement.

Yet another object of the present invention is to provide such a folder type container that employs angled sides that provide for a lock to be fashioned out of material that otherwise could not be used and would be wasted in the manufacturing process.

Yet another object of the present invention is to provide such a folder type container that employs such angled sides wherein the angle can be adjusted on each size of container so as to minimize waste on the lead edge.

Still another object of the present invention is to provide such a folder type container that minimizes the number of flaps.

Another object of the present invention is to provide such a folder type container that allows for in-box cutting of pizza.

According to the invention, generally stated, a folder type paperboard container is provided formed from a single piece having a hexagonal bottom wall panel, a rear wall panel, a front wall panel, a pair of side wall panels and a cover panel. The front wall panel includes a tuck that adds strength to the location and also serves as a locking mechanism. The locking mechanism does not extend beyond the front panel. The cover panel includes two depending flaps that cooperate with and are part of the locking mechanism. Generally speaking the present invention provides a folder type container that includes an angled front lock mechanism that secures the cover in place, requires less material, and increases the strength of the center front section of the box where it generally is grasped by a handler.

BRIEF DESCRIPTION OF THE DRAWINGS

Corresponding reference numerals indicate corresponding elements throughout the various figures. d

DESCRIPTION OF THE PREFERRED EMBODIMENT

Figure 1:
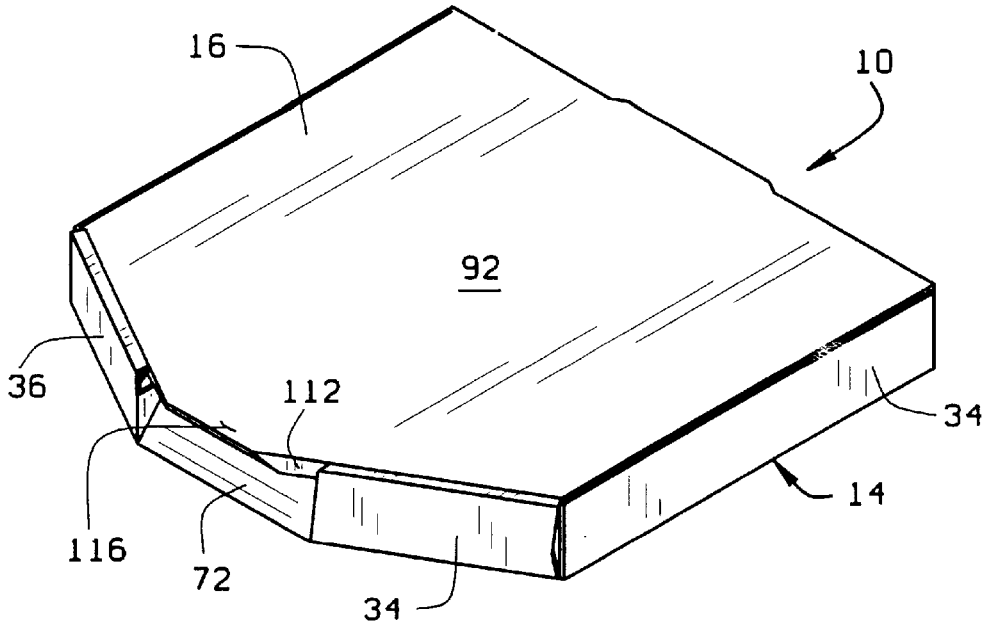
FIG. 1 is a perspective view of one preferred embodiment of the folder type container of the present invention.
Figure 2:
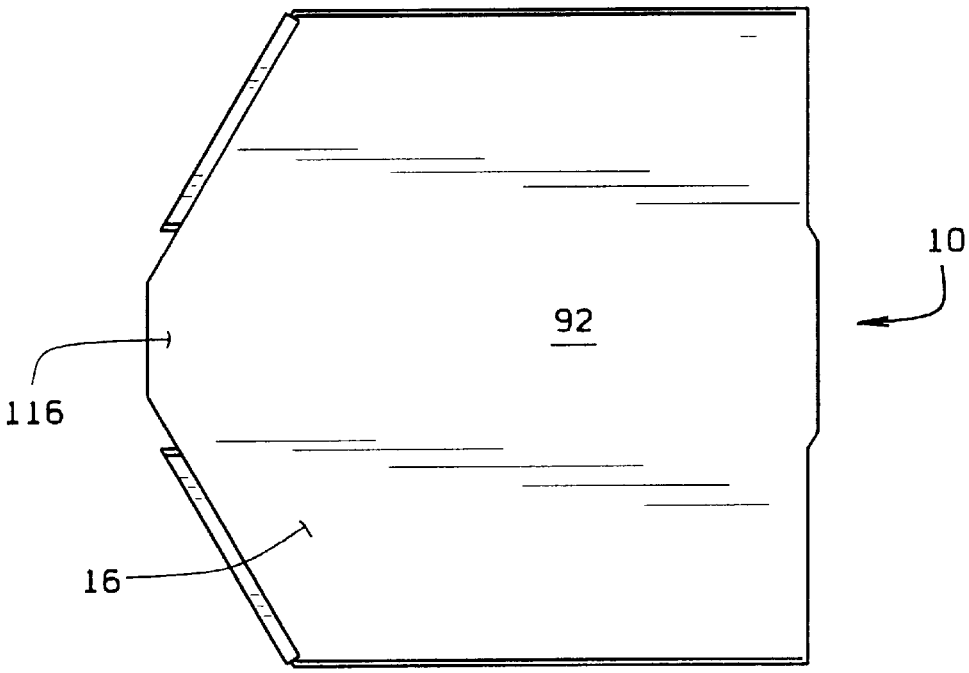
FIG. 2 is a top plan thereof.
Figure 6:
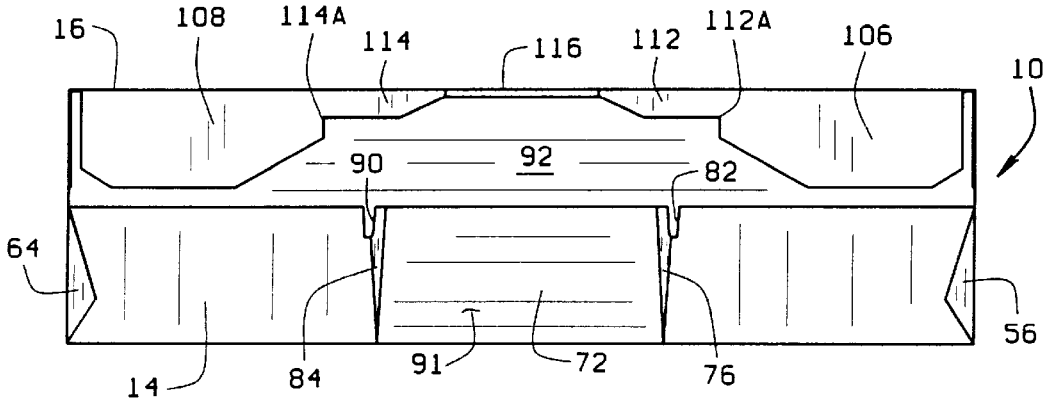
FIG. 6 is another front elevational view thereof, with the cover in an open position.

The folder type container of the present invention is indicated generally in the drawings by reference numeral 10. Container 10 may be formed from the unitary blank of foldable paperboard indicated generally by reference numeral 12 in FIG. 7. As best seen in FIGS. 1 and 6, container 10 is comprised of a bottom folder section 14 and a cover 16. It will be appreciated from the drawings that cover 16 is positioned over the bottom section 14 in an overlying arrangement and can be moved from an open position to a closed position so as to cover the contents of bottom folder section 14. Further, as will be explained in greater detail below, cover 16 can be secured in the closed position by a novel locking mechanism that not only keeps the cover in place but also creates means for conveniently opening the cover. Moreover, the novel locking mechanism also functions to support container 10 at the front center section which often is the point at which a handler grasps the container.

Figure 7:
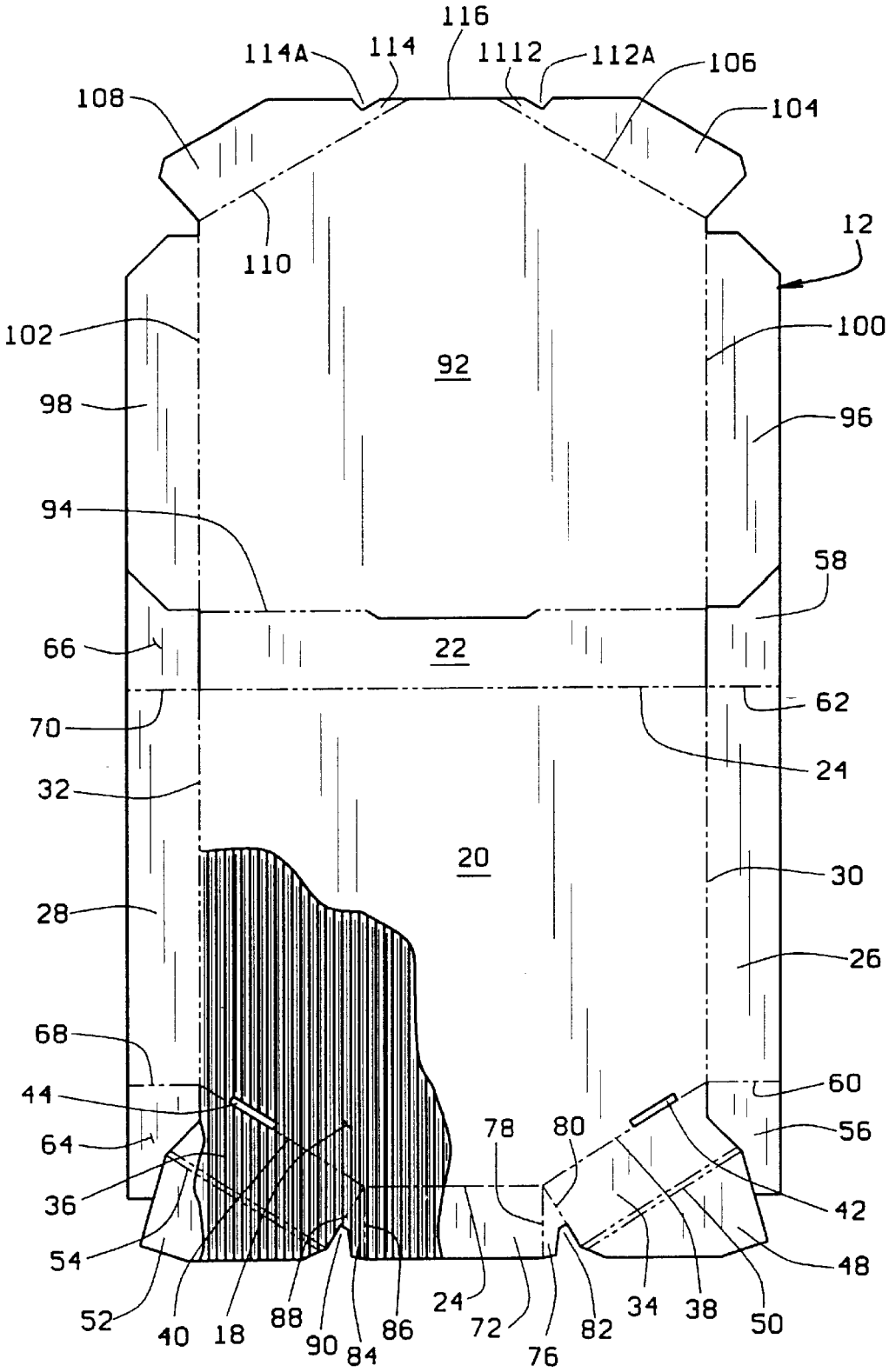
FIG. 7 is a top plan of the paperboard blank from which the embodiment of the folder type container of the present invention showing in FIGS. 1–6 is erected, the top layer partially cut away to show an embodiment formed from a fluted medium.
Figure 8E:
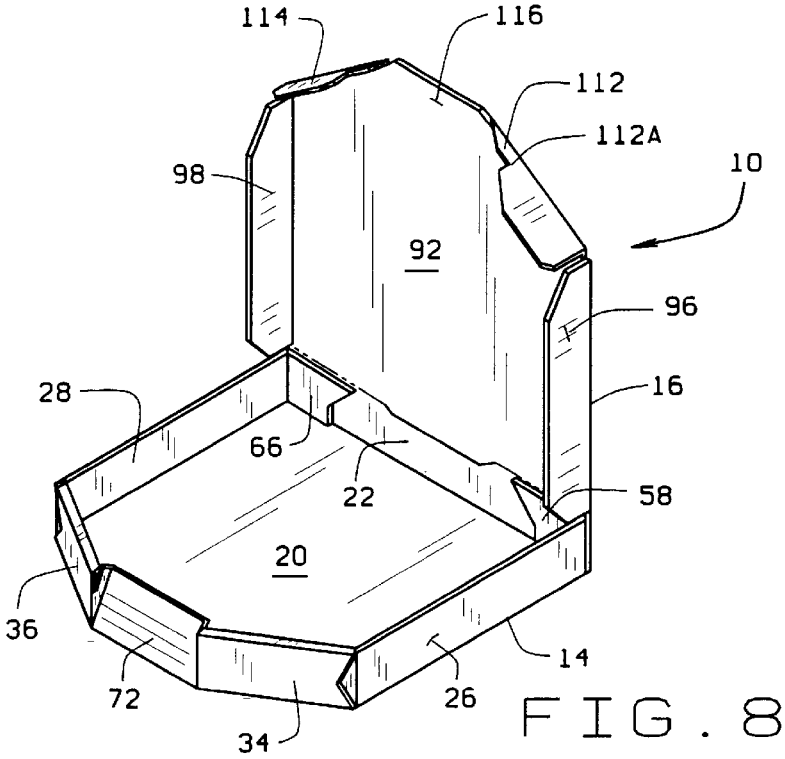
FIGS. 8A–8E are perspective views illustrating the blank in various stages of erection into the folder type container of the present invention.

The various elements which cooperate to form bottom folder section 14 are best seen in FIGS. 7–8E. FIG. 7 illustrates the foldable blank 12 which is erected into container 12 by the steps shown in FIGS. 8A–8E. It will be appreciated that the sequence in which the various elements are erected are not critical to the scope of the invention. That is, one erecting container 10 from blank 12 can use any particular sequence that allows quick and efficient erection of the container from blank 12. Blank 12 is a cut from paperboard stock which is comprised generally is a paperboard material. One embodiment of the paperboard material having a medium including a plurality of parallel flutes 18, as shown in FIG. 7. The uniquely angled panels which roll over and capture flaps 56 and 64 are designed to effectively lock into the bottom folder panel 20 irrespective of flute direction.

Referring now to the drawings, and in particular FIGS. 7–8E, bottom section 14 includes a bottom folder panel 20 with a rear panel 22 foldably connected to a rear edge along fold line 24, a first side panel 26 and a second side panel 28 connected along fold lines 30 and 32 respectively. The bottom section also includes a first corner panel 34 and a second corner panel 36 connected to bottom panel 20 along fold lines 38 and 40 respectively. It will be noted that the fold lines 38 and 40 are positioned diagonally to the side panels so that when the corner panels are folded into a useful configuration, they form corners arranged diagonally to the side panels. The fold lines 38 and 40 have tab locking slots 42 and 44 formed therein respectively. First corner panel 34 includes a first corner panel retention tab 48 joined along fold line 50. Second corner panel 36 includes a second panel retention tab 52 joined along fold line 54. It will be appreciated that the tips of the respective panel retention tabs are designed to engage slots 42 and 44 when the container is assembled.

First side panel 26 also includes a first retention tab 56 at a first end and a second retention tab 58 at a second end foldably joined to the side panel by fold lines 60 and 62 respectively. Second side panel 28 includes a first retention tab 64 at a first end and a second retention tab 66 at a second end foldably joined to the side panel by fold lines 68 and 70 respectively. It will be appreciated that retention tabs 56 and 64 are secured by corner panels 34 and 36 and the associated locking flaps 48 and 52 when the container is erected. Further, second retention tabs 58 and 66 are designed to fold inwardly and abut rear panel 22 when the container is erected.

Bottom folder 14 also includes a front panel 72 foldably connected along fold line 74. Front panel 72 also is connected to front corner panel 34 by a substantially triangular gusset 76 along fold lines 78 and 80. It will be appreciated that there is a notch 82 formed between gusset 76 and corner panel 34. Front panel 72 also is connected to corner panel 36 by a substantially triangular gusset 84 along fold lines 86 and 88. There is a notch 90 formed between corner panel 36 and gusset 84. It will be appreciated from the various figures that gussets 76 and 84, along with the connecting fold lines, allow front panel 72 to be angled inwardly when the container is erected creating a recess or space 91 between the corner folder panels. This inward angling of front panel 72 allows container 10 to satisfy several desirable objects of the invention, as will be described in greater detail below. Further, it will be appreciated from viewing the figures that the bottom section, when the various elements are erected into its useful configuration, as explained above, has a generally hexagonal shape. However, it will be appreciated by those skilled in the art that certain novel elements of the container, including the locking mechanism and overhang, as will be explained to greater detail, can be used with folders having other configurations, such as octagon, rectangle and so forth. The hexagonal configuration shown in the drawings simply is one illustrative embodiment.

Figure 7A:
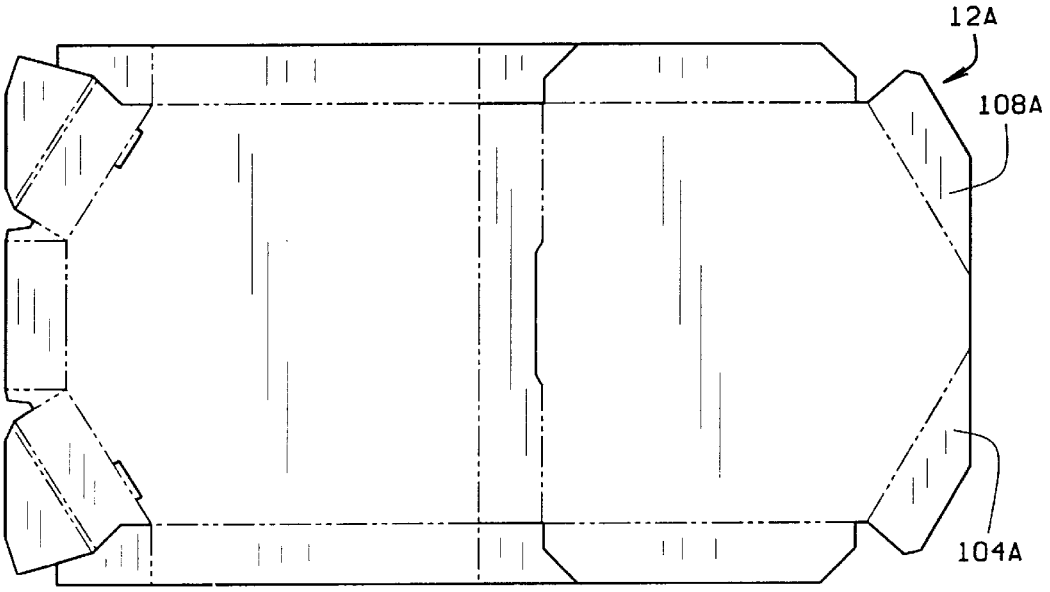
FIG. 7A is a top plan of the paperboard blank from another embodiment of the folder type container of the present invention is erected.
Figure 8A:
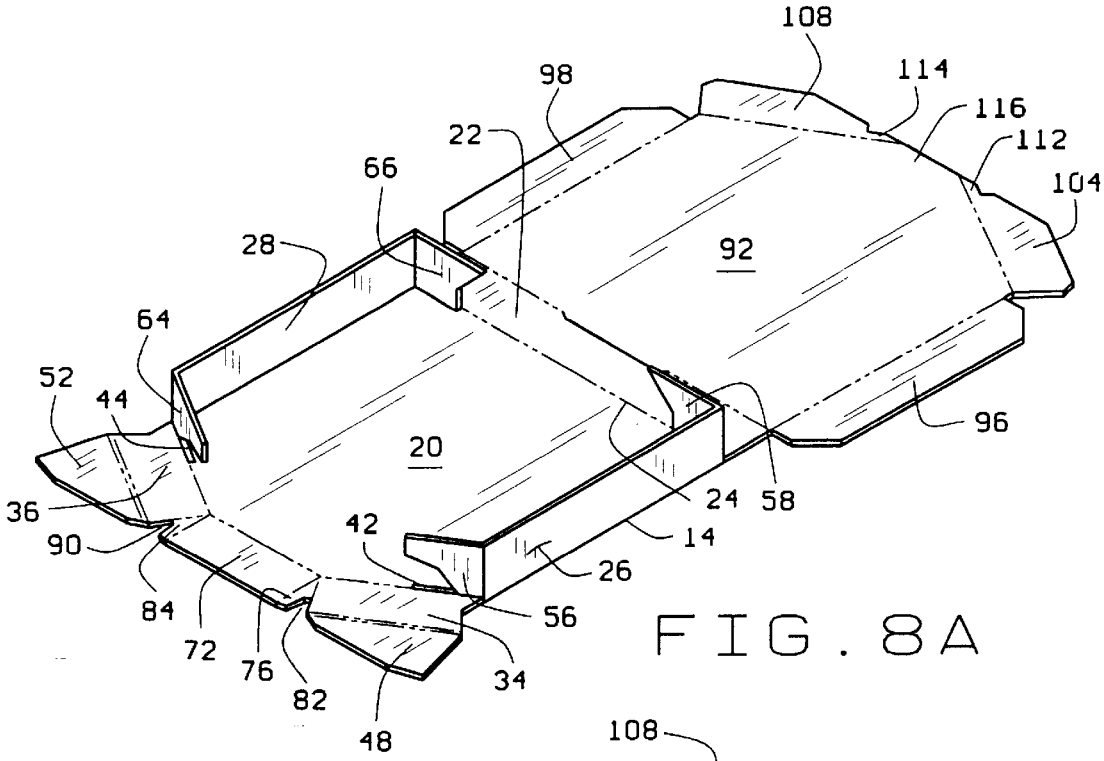
Figure 8B:
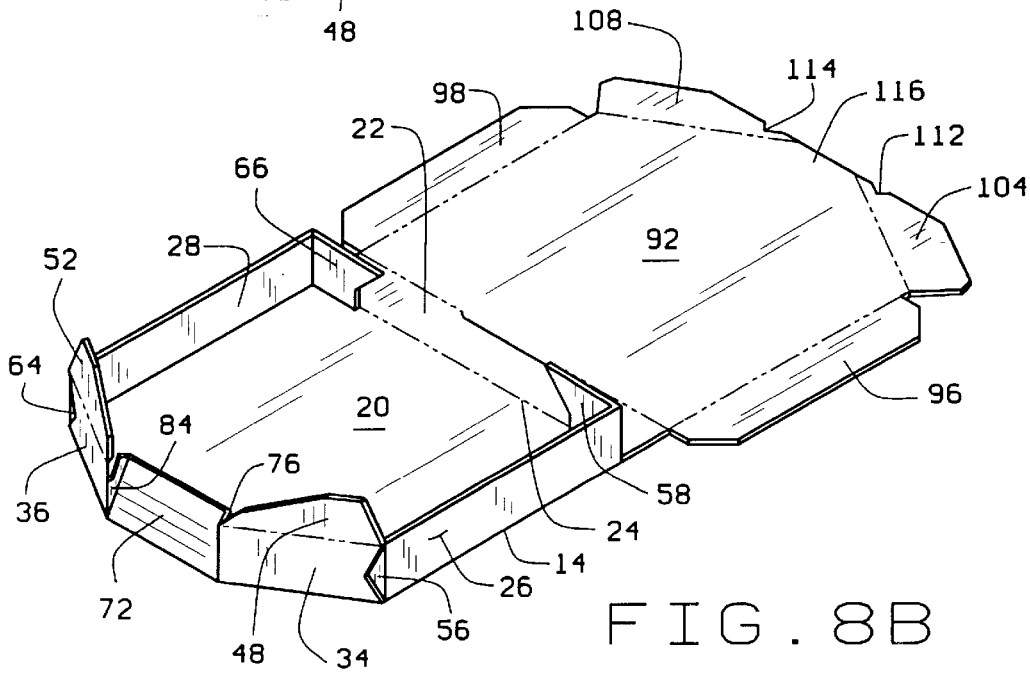
Figure 8C:
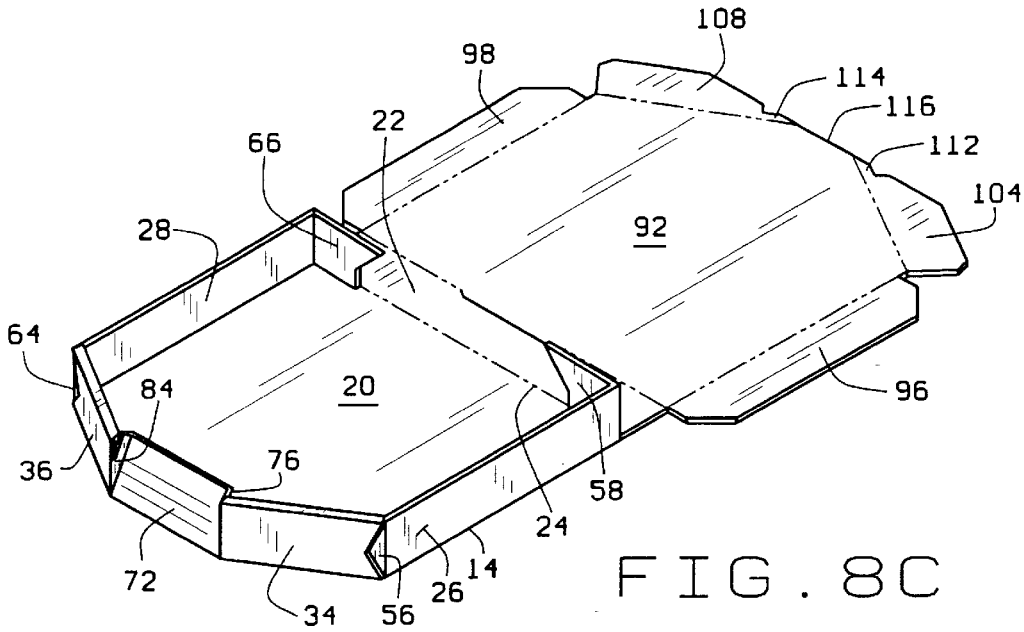
Figure 8D:
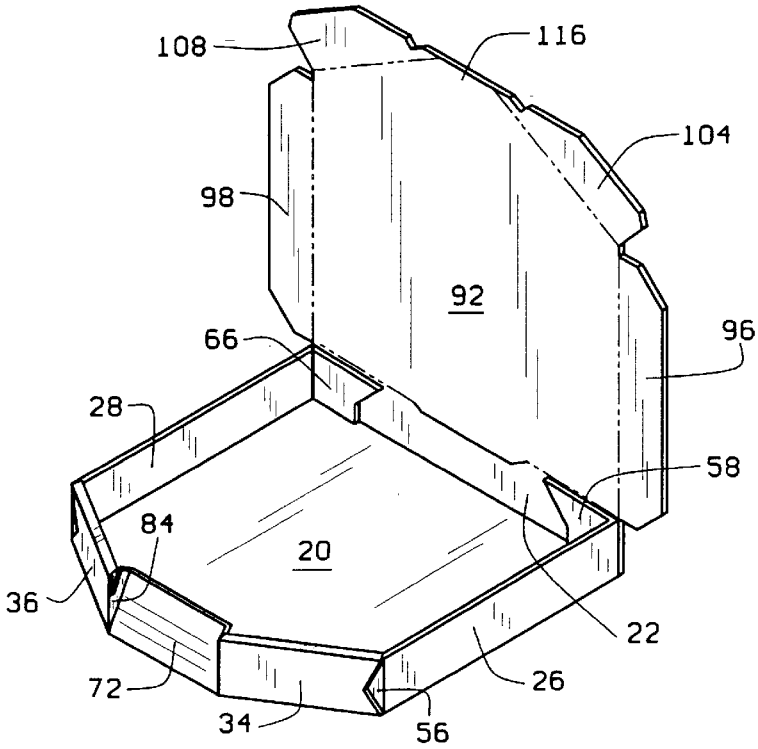

Cover 16 now will be described in greater detail. Cover 16 includes a top wall panel 92 which is foldably joined to rear folder panel 22 along fold line 94. Top wall 92 includes a first cover side panel 96 and a second cover side panel 98 joined along fold lines 100 and 102 respectively. Further, top wall 92 includes a first corner locking flap 104 foldably connected to a front corner along fold line 106 and a second corner locking flap 108 connected along fold line 110. The locking flaps further include locking extensions 112 and 114 with notches 112A and 114A respectively. FIG. 7A illustrates an alternative embodiment of a paperboard blank, indicated generally by reference numeral 12A. It will be noted that the embodiment of blank 12A also includes a first corner locking flap 104A and a second corner locking flap 108A. However, the locking flaps 104A and 108A in this illustrative embodiment are devoid of any notches.

It will be appreciated that fold lines 106 and 108 are positioned diagonally to the respective cover side panels so that, when folded into a useful configuration, as can be seen in FIG. 8E, the cover has a hexagonal configuration the same as bottom folder 14. Further, a front edge 116 protrudes beyond the corners to form an overhang which satisfies one or more objects of the invention, as will be discussed immediately below.

Figure 3:
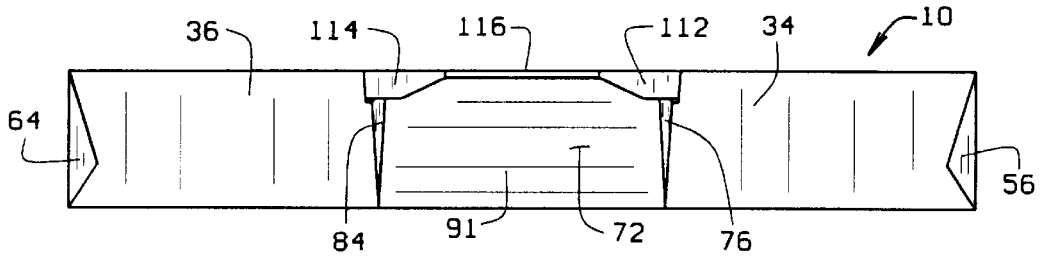
FIG. 3 is a front elevational view thereof.
Figure 4:
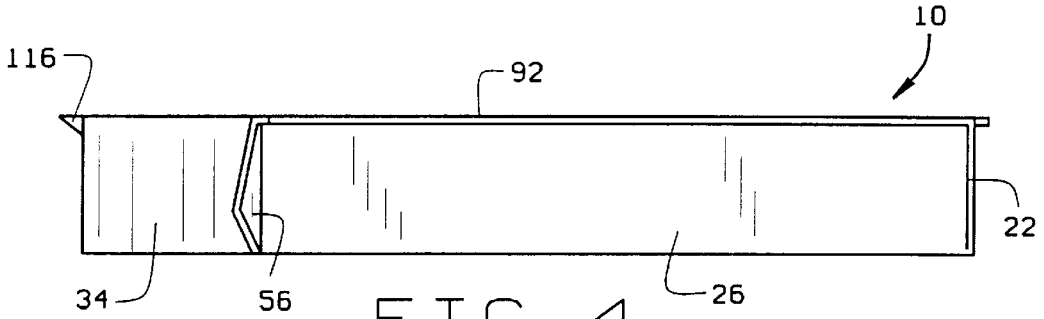
FIG. 4 is a side elevational view thereof.
Figure 5:
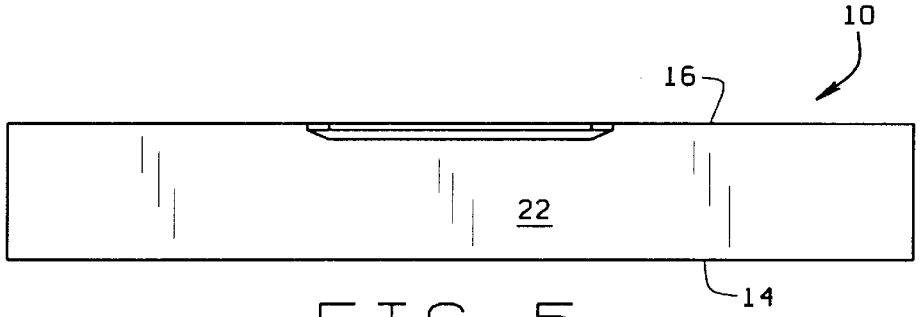
FIG. 5 is a rear elevational view thereof.

As can best be seen in the figures and particularly in FIGS. 3 and 6, when erected into their useful configurations, the previously described elements cooperate to meet the several objectives of the present invention. For example, the gussets 76 and 84 allow front folder panel 72 to be inwardly angled relative to the corner and side folder panels. Thus, when cover 16 is positioned in an overlying or closed position, as shown in FIGS. 1–4, the inwardly angled front folder panel 72 provides support under the top wall panel 92 of the cover 16 at the point where container 10 often is grasped by a user. Further, the overhanging relationship of edge 116 over the recess 91 provides a place for the user to insert his or her fingers to lift cover 16 to an open position, as shown in FIGS. 6 and 8E.

Moreover, cover 16, when in a closed position, is retained or locked closed by a novel mechanism which includes the frictional engagement of cover side panels 96 and 98 against bottom folder side panels 26 and 28 respectively, the frictional engagement of cover corner locking flaps 104 and 108 against the bottom folder corners, further secured by the seating of locking flap extensions 112 and 114 with notches 112A and 114A in notches 82 and 90 of gussets 76 and 84 respectively. In the embodiment of the invention erected from blank 12A show in FIG. 7A, the locking flaps 104A and 108B directly seat in notches 82 and 90. It will further be noted that because the various corner walls and flaps are positioned diagonally to the flutes 18, when fluted material is used, the unique locking mechanism just described can be used with corrugations running in either direction.

Figure 9A:
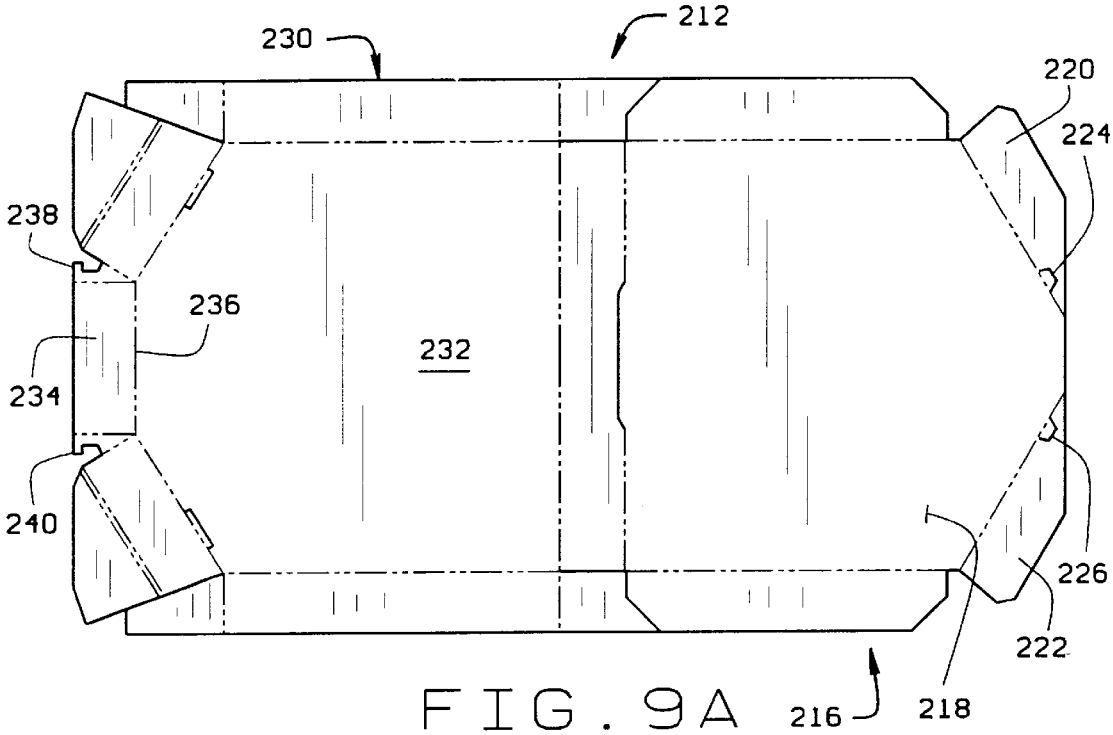
FIG. 9A is a top plan of the paperboard blank from which another embodiment of the folder type container of the present invention is erected.
Figure 9B:
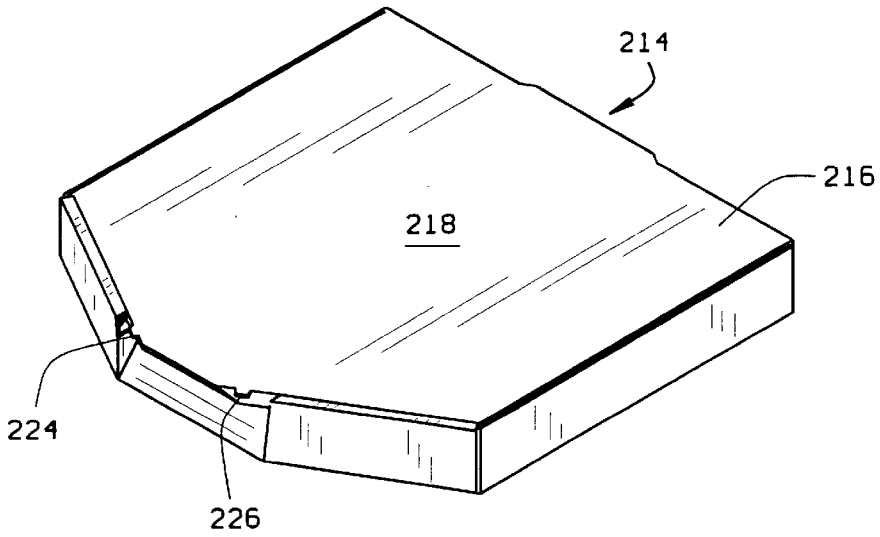
FIG. 9B is a perspective view of the embodiment folder type container of the present invention erected from the paperboard blank of FIG. 9A.

FIG. 9A illustrates an alternative embodiment of a blank, indicated generally by reference numeral 212 which is erected into an alternative embodiment of the folder type container of the present invention indicated generally by reference numeral 214 in FIG. 9B. As can be seen, container 214 has the general configuration of the previously described embodiments. However, as best seen in FIG. 9A, this embodiment of the container includes modified locking structures. Blank 212 includes a cover 216 having a top wall panel 218. Top wall panel 218 includes a first corner locking flap 220 and a second corner locking flap 222. The corner locking flaps 220 and 222 include punch-out tabs 224 and 226 respectively. It will be appreciated that when the container is erected, tabs 224 and 226 pop out (FIG. 9B) and create openings (not shown). Container 212 also includes a bottom section 230. Bottom section 230 includes a bottom wall panel 232 which has a front panel 234 foldably connected thereto along fold line 236. Front wall panel includes a first horizontally protruding locking tab 238 and a second horizontally protruding locking tab 240 at the gussets, the gussets being constructed similarly to those previously described. Locking tabs 238 and 240 are designed to engage the openings created by punch-out tabs 224 and 226 respectively when the container is erected and in use so as to lock the cover over the bottom section.

Figure 10A:
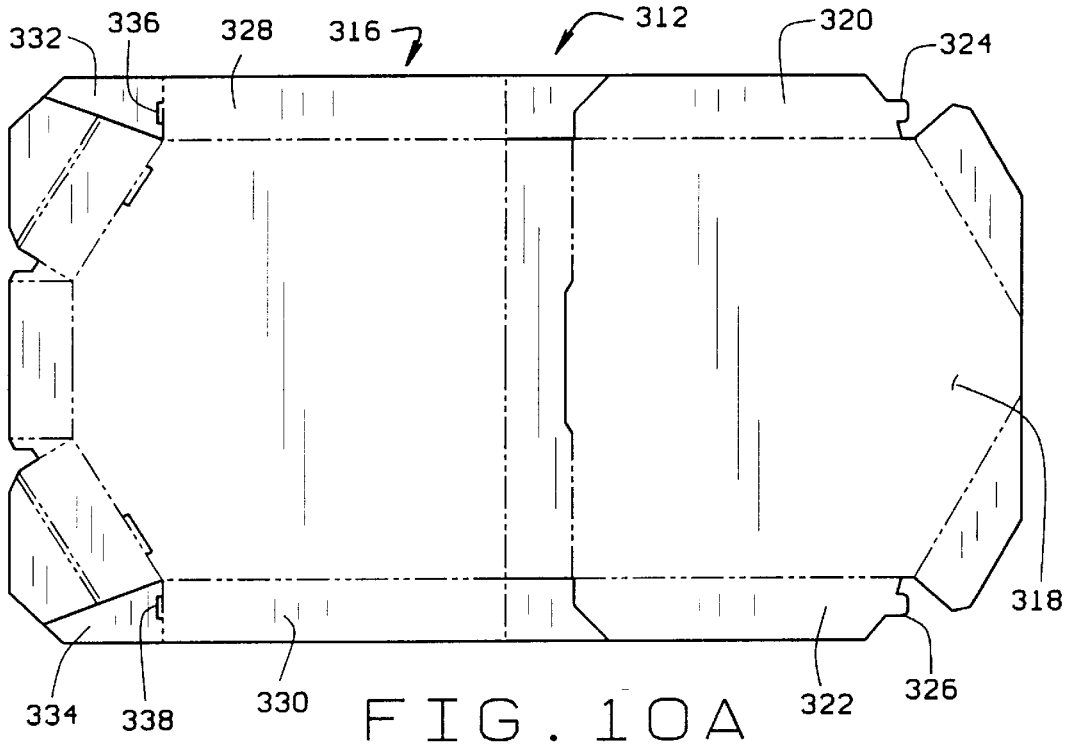
FIG. 10A is a top plan of the paperboard blank from which another embodiment of the folder type container of the present invention is erected.
Figure 10B:
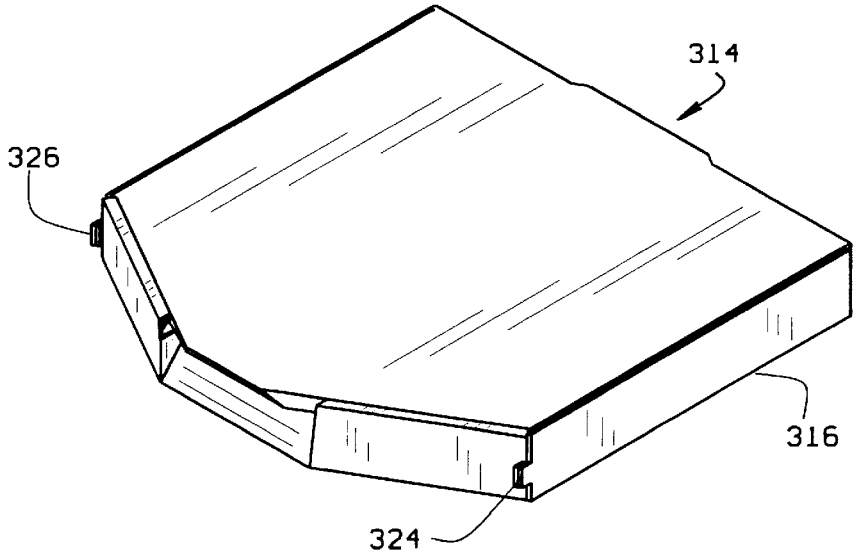
FIG. 10B is a perspective view of the embodiment folder type container of the present invention erected from the paperboard blank of FIG. 10A.

FIG. 10A illustrates another preferred embodiment of a blank 312 which is erected into another embodiment of the container of the present invention shown by reference numeral 314 in FIG. 10B. The embodiments of FIGS. 10A and 10B include elements that lock container 314 in an erected configuration. Container 314 includes a bottom section 316 and a cover 318. Cover 318 includes a first side panel 320 and second side panel 322. The respective side panels 320 and 322 include locking tabs 324 and 326. Bottom section 316 includes a first side panel 328 and a second side panel 330. First side panel 328 includes a retention tab 332 and second side panel 330 includes a retention tab 334. A first slot 336 is formed between first side panel 328 and retention tab 332 and a second slot 338 is formed between second side panel 300. The slots 336 and 338 are disposed to engage retention tabs 324 and 326, respectively, when the container is erected to lock the container in a stable, erected configuration, as shown in FIG. 10B.

Figure 11A:
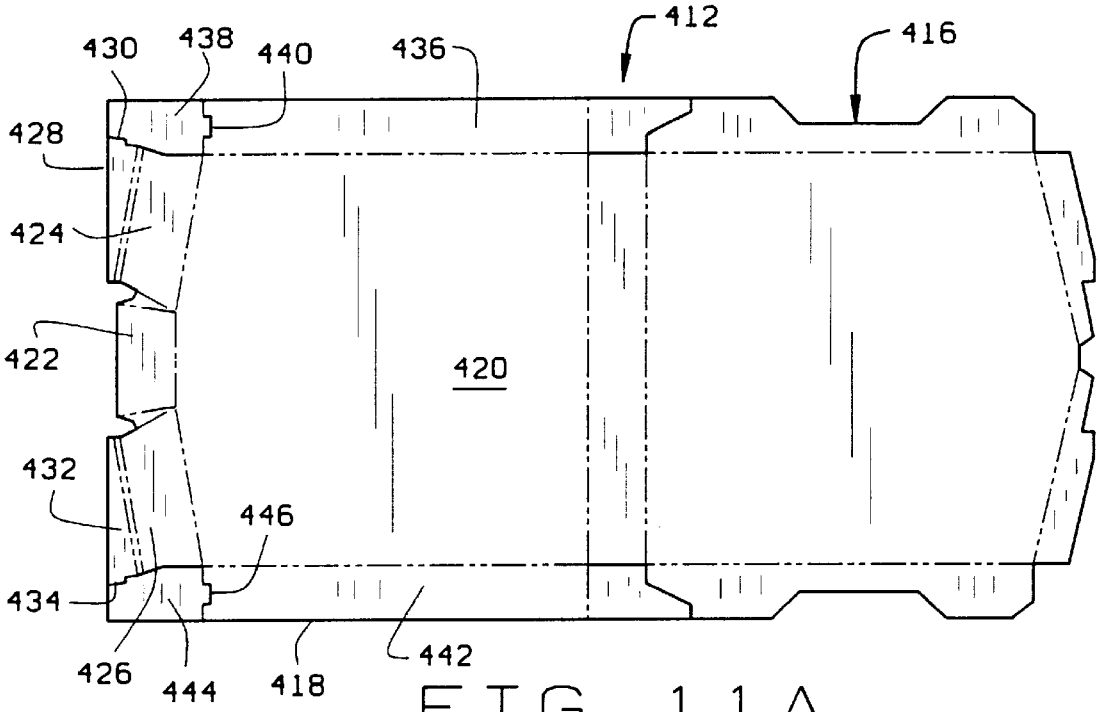
FIG. 11A is a top plan of the paperboard blank from which another embodiment of the folder type container of the present invention is erected.
Figure 11B:
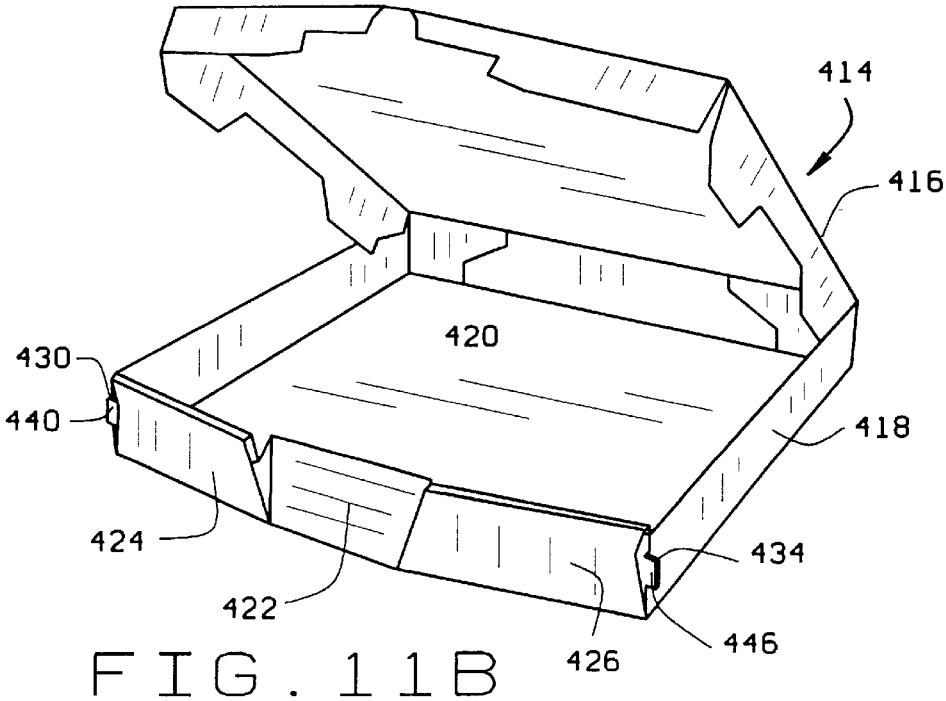
FIG. 11B is a perspective view of the embodiment folder type container of the present invention erected from the paperboard blank of FIG. 11A.

FIGS. 11A and 11B illustrate yet another preferred embodiment of the present invention constructed from a blank indicated generally by reference numeral 412. Blank 412 is erected into an alternative embodiment of the container of the present invention indicated generally by reference numeral 414 in FIG. 11B. Container 414 includes a cover 416 and a bottom section 418. Bottom section 418 has a bottom panel 420. A front wall 422 is foldably connected to the bottom panel via gussets, as previously described. The bottom panel also includes a first corner panel 424 and second corner panel 426. Corner panel 424 has a foldable locking extension 428. Extension 428 includes a tab 430. Corner panel 426 has a foldable locking extension 432 which includes a tab 434. Bottom panel 420 also includes a first side panel 436 which has a locking tab 438 with a tab/slot 440 formed therebetween. Bottom panel 420 also includes a second side panel 442 having locking tab 444 with tab/slot 446 therebetween. It will be appreciated when the bottom section is erected, tab/slot 440 and 446 pop out creating slot for the insertion of tabs 430 and 343 respectively so as to lock the container into a useful configuration.

The novel configuration has shown to require less material than conventional folder type containers. Since several blanks can be cut from stock in a side-by-side arrangement, the angled sides allows minimization of waste on the lead edge during manufacture.

Further, the configuration of the assembled container reduces unused internal space when housing a round pizza, thereby increasing the heat retention aspects of the container. Moreover, the novel design, which allows the front center panel to extend outward from the box. It will be appreciated, however, that the novel design of the front of the assembled container, including the locking mechanism and support structures, can be used with containers having different overall configurations, such as octagons, rectangles and so forth.

Since various changes and modifications may be made in the folder type container of the present invention without departing from the scope of the appended claims, the foregoing description and accompanying drawings are intended to be illustrative only and should not be construed in a limiting sense.

What is claimed is:

1. A folder-type container, said container being formed from a unitary blank of foldable material, comprising:

a bottom including bottom wall panel having a rear edge, a first and a second side edge, a first corner edge positioned diagonally to said first side edge, a second corner edge positioned diagonally to said second side edge, and a front edge positioned between and diagonal to said first and second corner edges;

a rear panel foldably attached to said rear edge and extending upwardly therefrom;

a first side panel and a second side panel foldably joined to said bottom wall panel at said first and second side edges, respectively, and extending upwardly therefrom;

a first corner panel foldably connected to said first corner edge and a second corner panel foldably connected to said second corner edge;

a first corner panel retention tab foldably joined to said first corner panel and a second corner panel retention tab foldably joined to said second corner panel;

a front panel foldably joined to said front edge, said front panel being foldably joined to said first corner panel and said second corner panel with a first and second gusset respectively, said each said gusset being foldable inwardly so that said front panel is inwardly angled relative to the adjacent corner panels thereby creating a recess at said front panel and between said first and second corner panels;

a cover foldably joined to said rear wall panel, said cover including a top wall panel, said top wall panel including a first side edge, a second side edge; a first corner edge positioned diagonally to said first side edge, a second corner edge positioned diagonally to said second corner edge, and a front edge between said first and second corner edge, said front edge being in an overhanging relationship with said inwardly angled front wall panel when said cover is positioned over said bottom wall panel; and a first corner locking flap foldably attached to said first corner edge of said top wall panel and a second corner locking flat foldably attached to said second corner edge; each said corner locking flap including a locking means notch formed therein, each said notch disposed to engage and seat in a gusset locking means retention slot when said cover is positioned over said bottom wall panel in a closed arrangement.

2. The folder type container of claim 1 wherein said first and second corner edges of said bottom wall each have a slot formed therein.

3. The folder type container of claim 1 wherein said first side panel has a first retention tab on a first end disposed to engage said first corner retention tab and said second side panel has a second retention tab on a first end disposed to engage said second corner retention tab.

4. The folder type container of claim 1 wherein the bottom further comprises said first side panel having a second retention tab on a second end disposed to engage said rear wall, said second side panel having a second retention tab on a second end disposed to engage said rear wall.

5. The folder type container of claim 1 wherein the unitary blank is comprised of a paperboard material having at least one fluted layer having a plurality of parallel flutes.

6. The folder type container of claim 5 wherein said first corner folder panel retention tab and said second corner folder panel retention tab are diagonal to said plurality of flutes.

7. The improved folder type container of claim 1 wherein the cover further comprises a front edge section that extends over said recess when the cover is positioned over the bottom tray section wherein said front edge functions as a grasping area to facilitate the movement of the cover from a closed to an open position.

8. A folder-type container, said container being formed from a unitary blank of foldable material, comprising:

a bottom including bottom wall panel having a rear edge, a first and a second side edge, a first corner edge positioned diagonally to said first side edge, a second corner edge positioned diagonally to said second side edge, and a front edge positioned between and diagonal to said first and second corner edges; said first and second corner edges of said bottom wall each have a slot formed therein;

a rear panel foldably attached to said rear edge and extending upwardly therefrom;

a first side panel and a second side panel foldably joined to said bottom wall panel at said first and second side edges, respectively, and extending upwardly therefrom;

a first corner panel foldably connected to said first corner edge and a second corner panel foldably connected to said second corner edge;

a first corner panel retention tab foldably joined to said first corner panel and a second corner panel retention tab foldably joined to said second corner panel; said first corner panel retention tab is has an upper edge disposed to engage the slot in said first bottom panel corner edge and said second corner panel retention tab has an upper edge disposed to engage the slot in said second bottom panel corner edge;

a front panel foldably joined to said front edge, said front panel being foldably joined to said first corner panel and said second corner panel with a first and second gusset respectively, said each said gusset being foldable inwardly so that said front panel is inwardly angled relative to the adjacent corner panels thereby creating a recess at said front panel and between said first and second corner panels;

a cover foldably joined to said rear wall panel, said cover including a top wall panel, said top wall panel including a first side edge, a second side edge; a first corner edge positioned diagonally to said first side edge, a second corner edge positioned diagonally to said second corner edge, and a front edge between said first and second corner edge, said front edge being in an overhanging relationship with said inwardly angled front wall panel when said cover is positioned over said bottom wall panel; and a first corner locking flap foldably attached to said first corner edge of said top wall panel and a second corner locking flat foldably attached to said second corner edge.

9. In a folder type container having a bottom section which includes a bottom panel, a pair of opposed side panels extending upwardly from the bottom panel, a rear panel extending upwardly from the bottom panel and a cover foldably connected to said rear panel and positioned to cover the bottom section in an overlying arrangement, the improvement comprising:

a first diagonal corner panel extending upwardly from a front edge of said bottom panel and a second diagonal corner panel extending upwardly from the front edge of said bottom panel;

a front panel between said first diagonal corner panel and said second diagonal corner panel, said front panel being foldably attached to each of said diagonal corner panels by a first and second gusset, respectively, said front panel extending upwardly from said bottom panel in an inwardly angled arrangement thereby creating recess between said first and second diagonal corner panels;

the cover further comprising a front edge section that extends over said recess when the cover is positioned over the bottom folder section wherein said front edge functions as a grasping area to facilitate the movement of the cover from a closed to an open position; the cover further comprising a first corner locking flap foldably attached to a first corner edge of said cover and a second corner locking flap foldably attached to a second corner edge of said cover, each said corner locking flap including a locking means notch formed therein, each said notch disposed to engage said first and second gusset respectively when said cover is positioned over said bottom folder section in a closed arrangement.

* * * * *